US007802687B2

(12) United States Patent
Fritz et al.

(10) Patent No.: US 7,802,687 B2
(45) Date of Patent: Sep. 28, 2010

(54) COATING POWDER SIEVING DEVICE

(75) Inventors: Hans-Georg Fritz, Ostfildern (DE); Marcus Treppschuh, Kirchheim (DE)

(73) Assignee: Durr Systems Inc., Auburn Hills, MI (US)

( * ) Notice: Subject to any disclaimer, the term of this patent is extended or adjusted under 35 U.S.C. 154(b) by 142 days.

(21) Appl. No.: 11/443,976

(22) Filed: May 31, 2006

(65) Prior Publication Data

US 2006/0266284 A1 Nov. 30, 2006

(30) Foreign Application Priority Data

May 31, 2005 (DE) ..... 10 2005 024 854

(51) Int. Cl.
*B07B 1/42* (2006.01)

(52) U.S. Cl. ..... 209/365.1; 209/364; 209/346

(58) Field of Classification Search ..... 209/254, 209/346, 347, 364, 365.1, 365.3, 401, 409–421
See application file for complete search history.

(56) References Cited

U.S. PATENT DOCUMENTS 2,468,550 A * 4/1949 Fruth ..... 8/159
2,784,842 A * 3/1957 Cover ..... 209/254
2,880,871 A * 4/1959 Bruninghaus ..... 209/310
3,463,321 A * 8/1969 Vaningen ..... 210/388
4,816,144 A * 3/1989 Monteith ..... 209/364
5,398,816 A * 3/1995 Senapati ..... 209/364
5,542,548 A * 8/1996 Senapati ..... 209/365.1
5,799,799 A * 9/1998 Alamzad et al. ..... 209/365.1
2005/0072717 A1* 4/2005 Purohit et al. ..... 209/309

FOREIGN PATENT DOCUMENTS

WO PCT/EP98/05421 3/1999

* cited by examiner

*Primary Examiner*—John Q Nguyen
*Assistant Examiner*—Kalyanavenkateshware Kumar
(74) *Attorney, Agent, or Firm*—Rader Fishman Grauer

(57) ABSTRACT

The invention relates to a coating powder sieving device, specifically for a powder paint coating installation, having a screen surface for sieving a coating powder. The screen surface is angular. An ultrasonic probe excites vibrations in the screen surface wherein the vibrations in the screen surface occur substantially in a direction perpendicular to the screen surface. A powder fluidization hopper incorporating the coating powder sieving device and a powder coating installation including plural powder fluidization hoppers are also disclosed.

14 Claims, 9 Drawing Sheets

COATING POWDER SIEVING DEVICE

CROSS-REFERENCE TO RELATED APPLICATIONS

This application claims priority from German Patent Application No. 10 2005 024 854.3, filed May 31, 2005, the entire contents of which is incorporated herein by reference.

TECHNICAL FIELD

The invention relates to a coating powder sieving device for a powder paint coating installation.

BACKGROUND

In powder coating installations, powder management centers (PMC) are used to supply the powder in which the coating powder is fluidized so that it can be fed into the powder circulation line of the powder coating installation. Such powder management centers consist essentially of a cylindrical hopper having a round ultrasonic sieve located on the top side and a similarly round fluidizing bed located on the underside.

Filling of the powder management center with the coating powder is carried out by way of the ultrasonic sieve as virgin powder and/or reclaimed powder is brought up to the top side of the screen surface of the ultrasonic sieve so that suitable coating powder is sieved through the screen surface into the hopper.

Fluidization of the coating powder present in the hopper is carried out by blowing air into the hopper through the fluidization bed so that the coating powder present in the hopper is always in a fluidized state during operation.

The fluidized coating powder can then be removed through a side outlet in the hopper by a powder conveyor pump, such as for example a digital dense flow (DDF) pump, and pumped to application equipment, such as for example a powder atomizer.

From DE 25 06 981, DE-PS 919 758 and DE 196 21 448 C1, sieving devices are known that have an angular screen surface, but these sieving devices are based on a technically different screening principle, since the screen surface itself does not perform any transverse oscillations perpendicular to the plane of the screen surface. Instead, the entire sieve frame with the screen surface is set in a low-frequency rocking and side-to-side oscillation. In addition, these known sieving devices are not suitable for use in a powder paint coating installation.

Citations DE 202 20 680 U1 and DE-US 2 223 146 disclose additional sieving devices with a round screen surface and are also unsatisfactory.

Citation DE 81 11 525 U1 additionally discloses a seal for a sieving device.

Finally, a sieving device is known from WO 99/10111 A1 in which an angular screen surface lies loose on a sieve frame. The screen surface is excited by a vibration motor to low-frequency vibratory oscillations in a frequency range of 0 to 480 Hz. The shape of the screen surface is of no consequence on account of the low-frequency vibratory excitation.

BRIEF SUMMARY OF THE INVENTION

In the powder management centers, since the screen surface of the ultrasonic sieve and the fluidization hopper must have an adequate cross-section the centers have a relatively large space requirement. The invention reduces the space requirement over the known powder management center described above. Embodiments of the invention comprise an angular screen surface in a coating powder sieving device (e.g., in an ultrasonic sieve) that reduces the space requirement in the lateral direction for a specified size of the screen surface. For a specified screen surface size, the width of a square screen surface is approximately 11% less than the width of a circular screen surface. The smaller space requirement in the lateral direction can be particularly useful when several powder management centers, each for one paint color, are to be set up to the side of a paint line since the individual paint management centers then have to be positioned closely together.

The coating powder sieving device in accordance with various aspects of the invention differs fundamentally from the known sieves cited initially in which the screen surface undergoes a rocking and side-to-side oscillation parallel to the screen surface. The screen surface in this coating powder sieving device vibrates perpendicular to the screen surface, whereas vibrations of the screen surface parallel to its plane are preferably prevented by suspending the screen surface.

The term used within the scope of the invention of an angular screen surface is not to be understood in the strictly mathematical-geometric sense, but includes, for example, screen surfaces with rounded corners or slightly curved side edges.

It was additionally determined in tests on conventional ultrasonic sieves having a circular screen surface that the outer areas of the screen surface are hardly used, which reduces the effectively usable screen surface. In contrast, tests on the coating powder sieve devices described within having an angular screen surface have shown that almost the entire screen surface is utilized so that these coating powder sieve devices work more effectively. This advantage derives from the fact that the vibration spreads out in a diamond shape on the angular screen surface in accordance with the invention and extends across the entire screen surface.

The screen surface is preferably rectangular, although a square screen surface is also possible. In one embodiment of the invention, the screen surface has lateral edges of different lengths, whereby the installation width of the coating powder sieve device can be further reduced in the direction of the shorter lateral edge. For example, the ratio of length of the lateral edges of the screen surface can be in the range between 1:1.5 and 1:2.5, where a ratio of approximately 1:1.8 has proven to be advantageous.

In one version of the invention, the screen surface is inclined from the horizontal so that the dirt particles retained on the top side of the screen surface migrate laterally, thereby preventing clogging of the screen surface by the dirt particles. The optimal angle of inclination of the screen surface depends on the coating powder being used and the design constraints of the coating powder sieving device. For example, the angle of inclination of the screen surface in the coating powder sieving device in accordance with the invention can be between 2° and 10° (relative to a complete circle of 360°), where an angle of inclination of the screen surface in the range between 2° and 6° has been shown to be advantageous. In addition, the possibility exists within the scope of the invention that the angle of inclination of the screen surface is adjustable, which allows adaptation to different powder properties.

With an inclined screen surface, the screen surface opens on its downward inclined lateral edge preferably into a dirt trap by means of which the screened out dirt particles can be collected and removed. Such a dirt trap can, for example, have a channel that extends along the downwardly-inclined lateral edge of the screen surface and catches the dirt particles migrating laterally across the screen surface.

As described, the coating powder sieve device has an ultrasonic probe to excite vibration in the screen surface, as is the case with the conventional ultrasonic sieves cited briefly at the outset. Here, the ultrasonic probe has an excitation frequency that is preferably higher than 20 kHz, 30 kHz or even higher than 50 kHz.

Although not required, the screen surface in the coating powder sieving device can have a mesh width in the micron range. For example, the mesh width of the screen surface can be in the range from 60 μm to 200 μm. The screen throughput can be, for example, in the range from 20 kg/hr to 200 kg/hr.

In one embodiment of the invention the screen surface is mounted in a special way. The support for the screen surface in the conventional ultrasonic sieves with a circular screen surface is provided by several contact points on the underside of the screen surface and two hollow rubber profiles running circumferentially that press on the screen from above and below and thereby hold it in place. In the coating powder sieving device described herein, in one embodiment the screen surface is held in place in the area of its lateral edges by at least one foam rubber element and/or at least one solid rubber element. For example, a foam rubber element can be located along the lateral edges of the screen surface on the upper side and the underside of the screen surface so that the screen surface is held between the upper foam rubber element and the lower foam rubber element. The invention is, however, not restricted to foam rubber regarding the material of the rubber elements but can also be implemented with other solid rubber elements or seal profiles to hold the screen surface in position.

A deflector cone is further located above the screen surface in an of the invention, which deflector cone distributes the coating medium on the screen surface. The flow of the coating powder against the deflector cone comes preferably from above, i.e., almost at right angles to the screen surface so that the deflector cone diverts the coating medium laterally and distributes it across the screen surface.

In the previously described embodiment having an inclined screen surface, the deflector cone is preferably located in the upper area of the inclined screen surface since the coating powder reaches the lower area of the screen surface automatically due to the inclination of the screen surface. The deflector cone is thus located in the upper half, the upper third or even the upper fourth of the inclined screen surface, where the optimal location of the deflector cone within the screen surface also depends on the angle of inclination of the screen surface.

Furthermore, an angular design is applicable not only to a coating powder sieving device but also to a powder application hopper such as that of the powder management center. The invention therefore also comprises such a powder application hopper with an angular cross-section in the horizontal direction.

Here too, the cross-section can be square or generally rectangular, where the previous discussions concerning the screen surface of the coating powder sieving device apply equally to the length ratio of the lateral surfaces so that in this regard reference is made to the previous description.

In such a powder application hopper, where the screen surface of the coating powder sieve device is matched to the cross-section of the powder application hopper, there is a coating powder sieving device on the upper side.

In the case of a powder application hopper in accordance with embodiments of the invention, one side wall of the powder application hopper can consist partially or entirely of a fluidization body that can have air blown in from outside. This prevents powder from caking on the inner wall of the powder application hopper in the area of the fluidization body. The side wall of the powder application hopper can, therefore, be angled from the vertical in the area of the fluidization body so that the cross-section of the powder application hopper increases toward the top. In spite of the angled alignment, this prevents the coating powder from being deposited on the inside of the fluidization body by air being blown in around the area of the fluidization body.

The deposition of coating powder on the interior wall of the powder application hopper can be prevented by the powder application hopper having interior walls that run essentially vertical below the coating powder sieve device and are not sloped, whereas the powder application hopper in the known powder management centers described at the outset expands conically upward. In these centers, this can lead to caking of the coating powder on the interior wall.

Further, the powder application hopper can have a fluid level sensor to measure the level of the fluidized coating powder present in the powder application hopper, where the fluid level sensor can be configured conventionally (e.g., as an ultrasonic sensor).

A further advantage of the rectangular design of the powder application hopper is that more than six outlets to connect powder conveyor, or application, pumps can be located in the side wall of the powder application hopper, where the individual connections can be cleaned better and are exposed to more consistent suction conditions than is the case with the known powder management centers described at the outset having a circular cross-section. For example, eight or more connections for application pumps can be located in the side wall of the powder application hopper in accordance with embodiments of the invention.

Embodiments of the invention can also comprise a complete powder coating installation with a coating powder sieving device and/or with a powder application hopper as described above.

Several powder application hoppers are preferably located one after the other to the side next to a paint line in the longitudinal direction of the paint line, where the adjacent powder application hoppers contain different coating powders. For example, the adjacent powder application hoppers along the paint line may contain coating powders of different colors.

Provision is made furthermore in a variant of the powder coating installation for fluid density control so that the fluidized coating powder present in the powder coating hopper always has a constant specified fluid density. A powder conveyor pump is provided to transfer the coating powder into the powder application hopper, and there is a fluid level sensor to measure fluid density in the powder application hopper. Regulation of fluid density in the application hopper is carried out by an air volume regulator that controls the fluid air volume such that the density calculated from the fluid level measured and the mass of the powder paint in the hopper corresponds to the specified value.

Finally, the invention comprises the novel use of a sieving device in accordance with embodiments the invention for sieving coating powder in a powder coating installation.

Other advantageous developments of the invention are explained in more detail in what follows, together with the description of the embodiments of the invention with reference to the figures.

BRIEF DESCRIPTION OF THE DRAWINGS

The description herein makes reference to the accompanying drawings wherein like reference numerals refer to like parts throughout the several views, and wherein.

DETAILED DESCRIPTION OF EMBODIMENTS OF THE INVENTION

An embodiment of a powder management center (PMC) 1 in accordance with aspects of the invention serves to supply powder in a powder coating installation, such as is used, for example, to paint automobile body parts.

Figure 1:
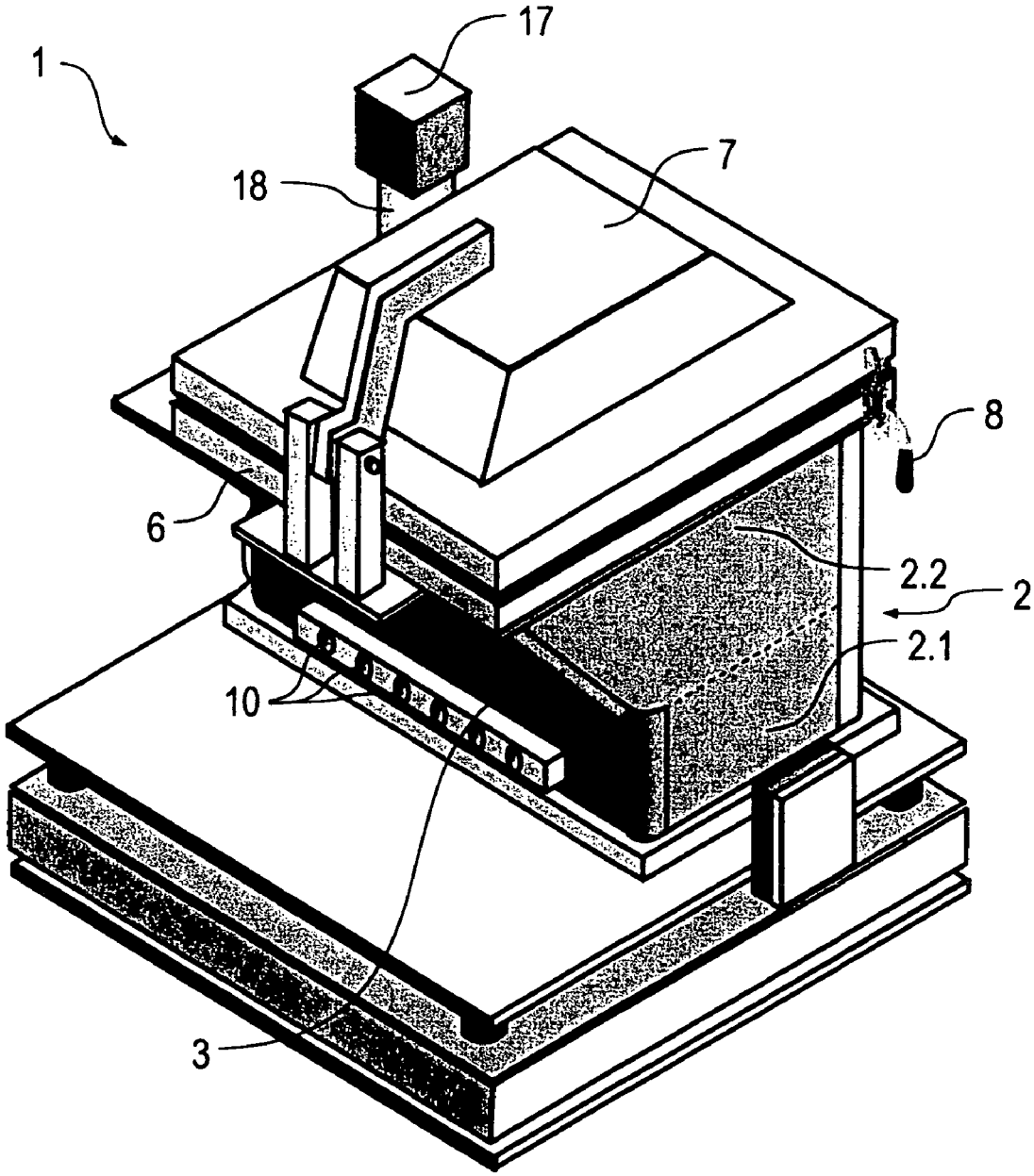
FIG. 1 shows a perspective view of a powder management center (PMC) for supplying powder in a powder coating installation.
Figure 2:
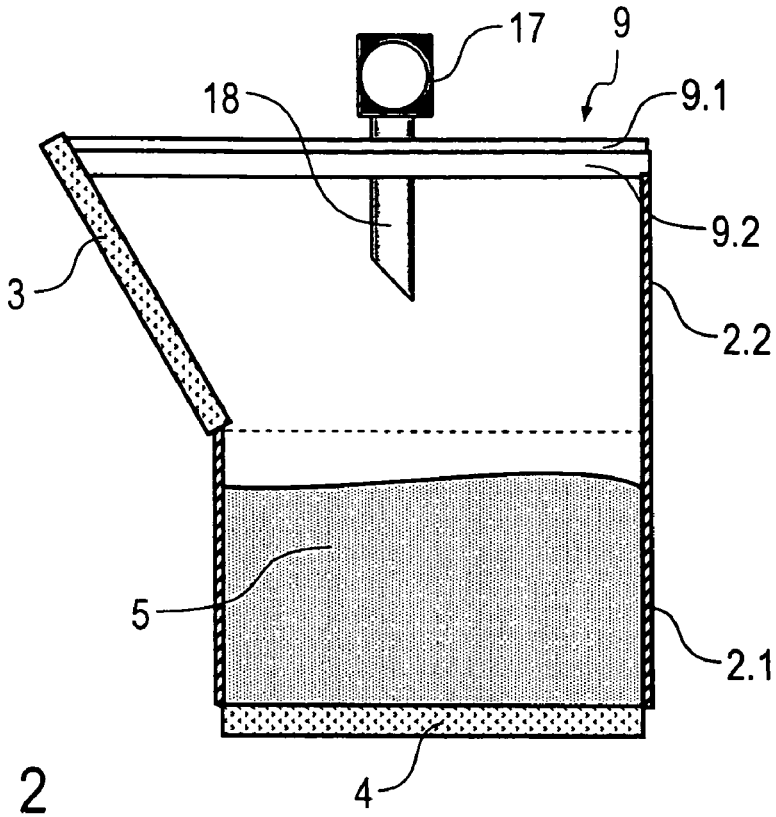
FIG. 2 shows a simplified cross-section of the powder management center from FIG. 1.

As shown in FIGS. 1 and 2, the underside of the powder hopper 2 is formed by a fluidization body floor impermeable to the coating powder and permeable to air, where air is blown into the powder hopper 2 during operation so that a coating powder 5 that has been filled into the powder hopper 2 is fluidized.

To fluidize the coating powder, the powder management center 1 has a powder hopper 2 with a rectangular cross-section, where the cross-section of the powder hopper 2 is constant in a lower area 2.1, while the cross-section of the powder hopper 2 in an upper area 2.2 of the powder hopper 2 grows wider towards the top on one side. A fluidization bed, or body, 3 is located in the sloping side wall of the powder container 2 in the upper area 2.2, whereby caking of the coating powder is prevented in the area of the slope.

The underside of the powder hopper 2 is formed by a fluidization body floor 4 impermeable to the coating powder and permeable to air, where air is blown into the powder hopper 2 during operation so that a coating powder 5 that has been filled into the powder hopper 2 is fluidized.

On its upper side, the powder hopper 2 has a circumferential frame 6 to which a cover 7 is pivotably attached, where the cover 7 can be locked in the closed position by means of a toggle clamp 8. Between the cover 7 and the frame 6 there is a rectangular screen, or sieve, surface 9, where the rectangular sieve surface 9 is excited by a conventional ultrasonic probe 34 (shown only in FIG. 4C).

Figure 3:
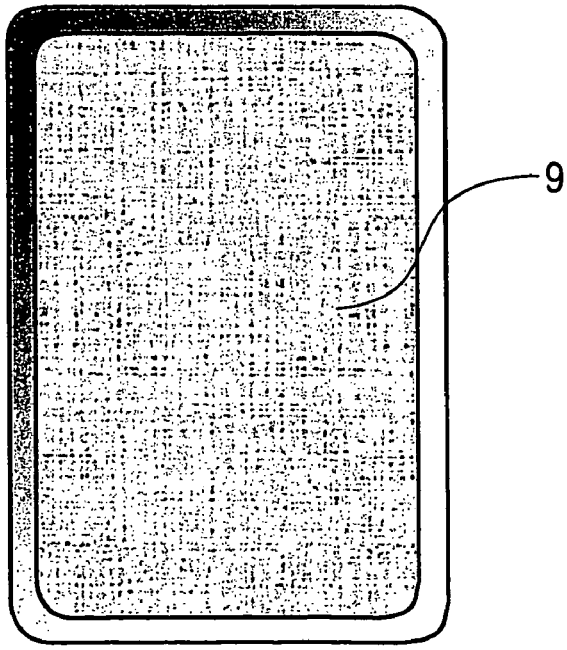
FIG. 3 shows a plan view of the screen surface of the ultrasonic sieve of the powder management center from FIG. 1.

The sieve surface 9 consists of a sieve mesh 9.1, which is stretched on a sieve frame 9.2 as is particularly clear from FIG. 2. A rectangular shape for the sieve surface is shown in FIG. 3.

Returning now to FIG. 1, a powder inlet for virgin powder and an additional powder inlet for reclaimed powder open into the cover 7 above the screen surface 9, where the coating powder fed in on the upper side of the screen surface 9 is distributed and screened through the screen surface 9. The two powder inlets for virgin powder or reclaimed powder are not shown here for the sake of simplicity.

Six outlets 10 to which the application pumps can be connected are located in the lower area 2.1 of the powder hopper 2 below the sloped bed 3 to remove the fluidized coating powder 5 from the powder management center 1. The arrangement of the outlets 10 on the longer lateral wall of the rectangular powder hopper 2 has the advantage that almost constant suction conditions are obtained at the individual outlets 10.

The powder management center 1 further permits fluid density regulation so that a powder flow of almost constant density is discharged through the outlets 10. As best seen in FIG. 2, to achieve this regulation the powder management center 1 has a fluid level sensor 17 with a probe 18, where the probe projects into the upper area 2.2 of the powder hopper 2 so that the fluid level is measured there. The fluid level measured thus can be transmitted to an air volume regulator 35 (shown in combination with a powder conveying pump in FIG. 5) that controls the fluidizing air volume such that the fluid density calculated from the fluid level measured and the mass of the coating powder 5 in the powder hopper 2 matches a specified value.

Figure 4A:
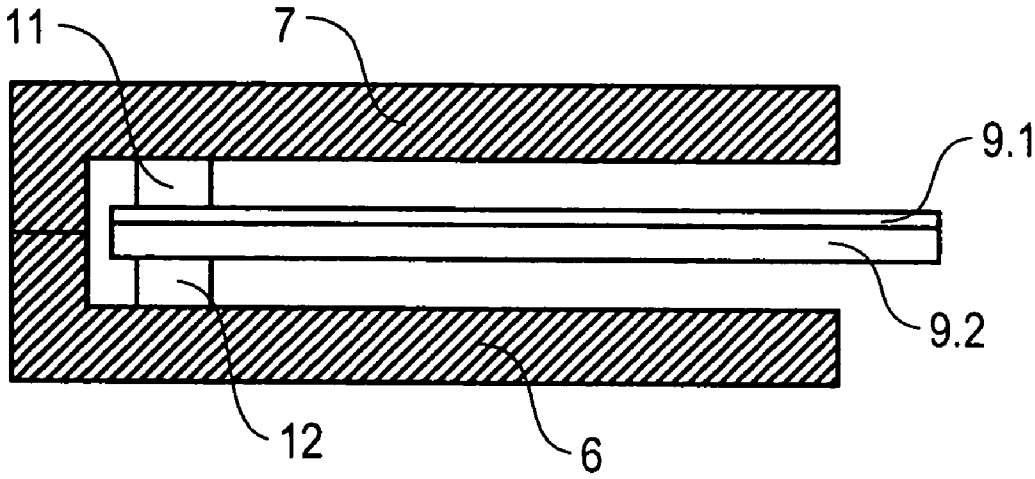
FIG. 4A shows a cross-sectional representation of a novel holding method for the screen surface in the ultrasonic sieve in the powder management center from FIG. 1.

FIG. 4A shows how the screen surface 9 can be held between the cover 7 and the frame 6 of the powder management center 1. It can be seen that the screen surface 9 is held against the upper side, or the underside, by a rectangular foam rubber element 11 or 12 running all the way round, which results in good vibration characteristics.

Figure 4B:
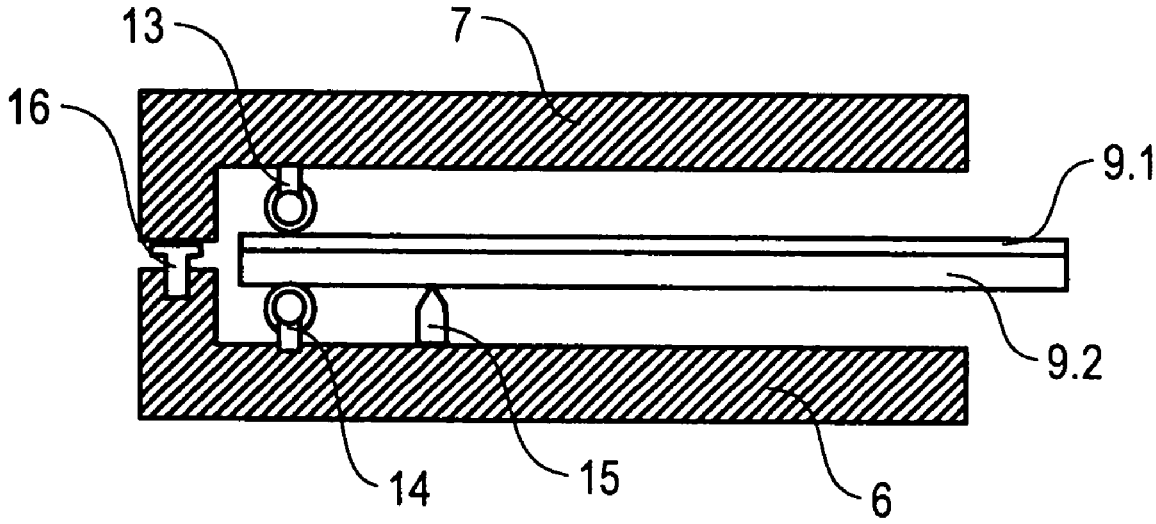
FIG. 4B shows an alternative holding method for the screen surface in the ultrasonic sieve.

FIG. 4B shows an alternative possibility for holding the screen surface 9 in place between the frame 6 and the cover 7. Hollow rectangular rubber profiles 13, 14 running the full circumference are provided on the outside of the screen surface 9. The profiles 13, 14 support the screen surface 9 in the vertical direction, damped against vibration. On the underside of the screen surface 9 there are several rigid mounts 15 (only one shown) in addition inside the rectangular circumferential hollow rubber profile 14, where each of the mounts 15 provides support at a single point. Furthermore, a buffer element 16 is located between the frame 6 and the cover 7.

Figure 4C:
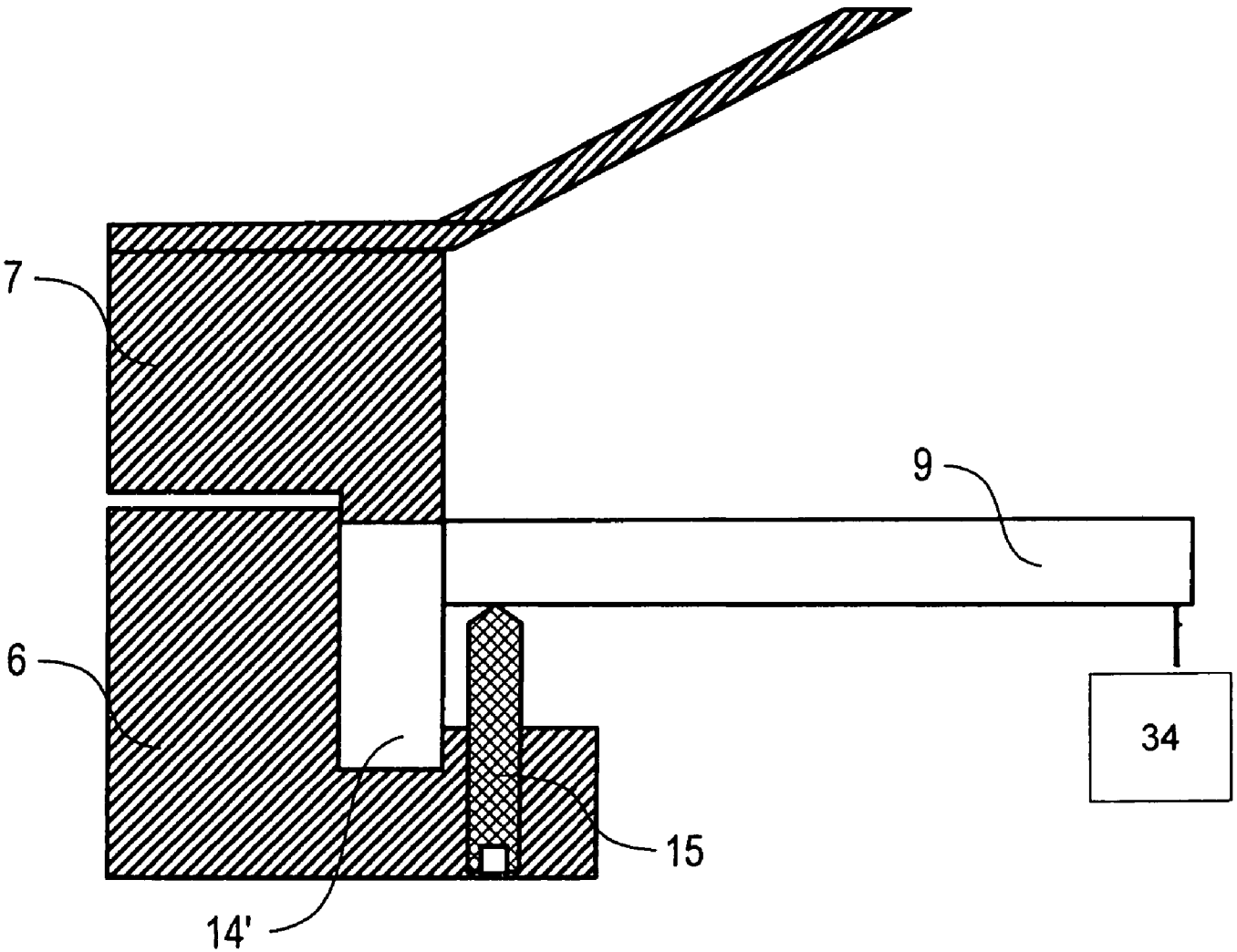
FIG. 4C shows an alternative holding method for the screen surface in the ultrasonic sieve.

FIG. 4C shows a further alternative version to hold the screen surface 9 in place between the frame 6 and the cover 7. This version partially corresponds to the previously described versions so that reference is made to the previous description to avoid repetition, where the same reference numerals are used for identical elements. One special feature of this version is that an annular seal 14' is located in a step running circumferentially between the cover 7 and the frame 6. For illustrative purposes, FIG. 4C also shows the conventional ultrasonic probe 34 coupled in a known manner to the screen surface 9. The ultrasonic probe 34 vibrates at a specified excitation frequency that is preferably higher than 20 kHz, 30 kHz or even higher than 50 kHz, imparting vibration to the screen surface 9. Uniquely, the manner in which the screen surface 9 is supported prevents vibration in a back-and-forth direction corresponding to the plane of the screen surface 9. Instead, substantially all the vibratory motion of the screen surface 9 is in a direction roughly perpendicular to the surface of the plane of the screen surface. These vibrations are supported and are absorbed in part by the supports, such as the annular seal 14' in FIG. 4C. Alternatively, although not shown, the ultrasonic probe 34 can be coupled to the components for holding the screen surface 9. In FIG. 4C, by example, this would be the annular seal 14'.

Figure 5:
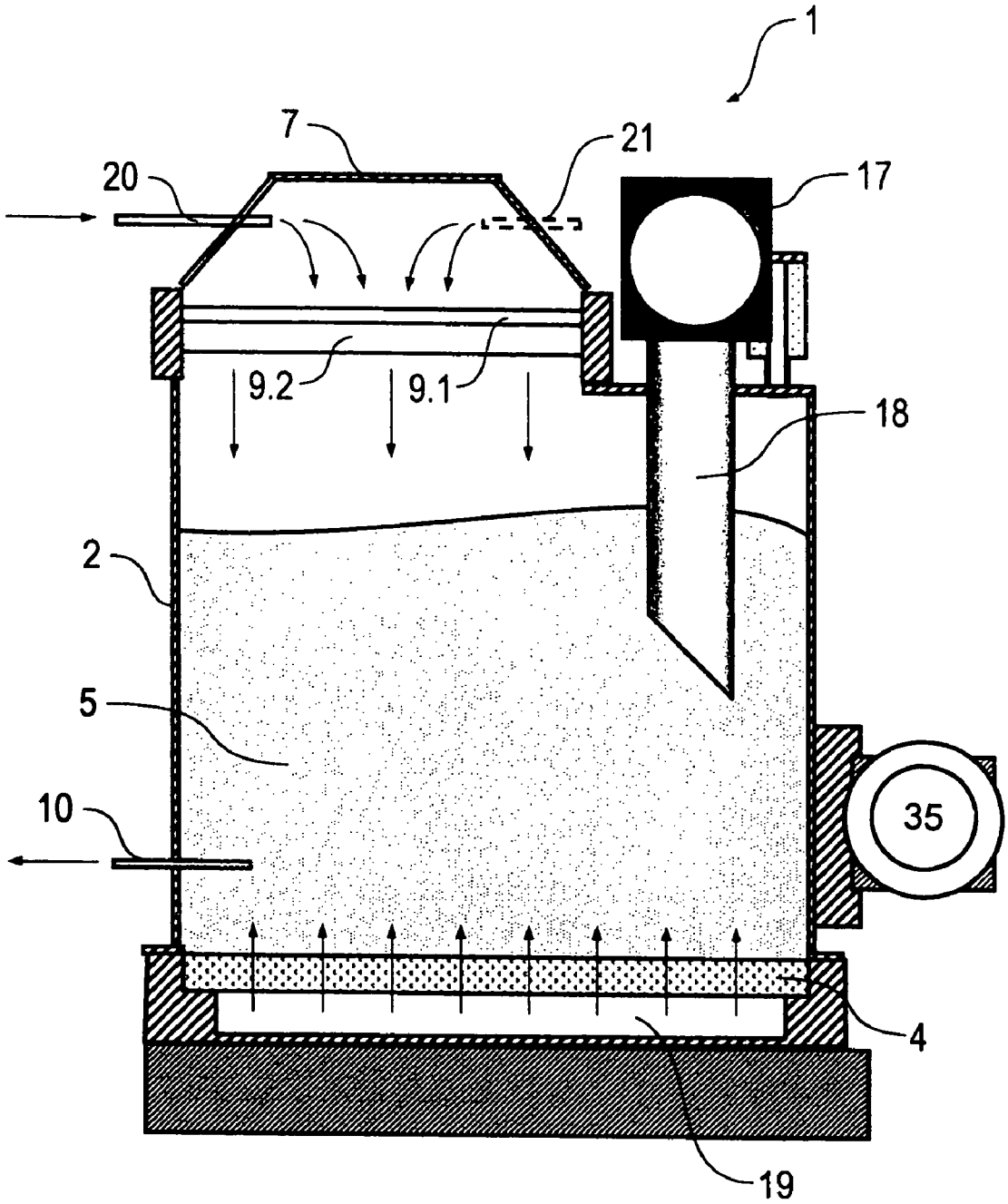
FIG. 5 shows a cross-sectional view of another embodiment of a powder management center.

FIG. 5 shows a cross-sectional view of an alternative embodiment of a powder management center 1. This embodiment is largely identical to the embodiment described previously, so that reference is made to the previous description to avoid repetition, where the same reference numbers are used for identical parts.

It can be seen in particular from this cross-sectional view that an air chamber 19 is located below the fluidization body floor 4 into which air is blown that flows in through the fluidization floor 4 upward into the powder hopper 2. In addition, an inlet 20 for virgin powder and an optional inlet 21 for reclaimed powder are shown in the cover 7.

In contrast to the embodiment of FIG. 1, in this embodiment the side walls of the powder hopper 2 are essentially vertical and do not slope, which largely prevents caking of the coating powder 5 on the interior wall of the powder hopper 2.

Figure 6:
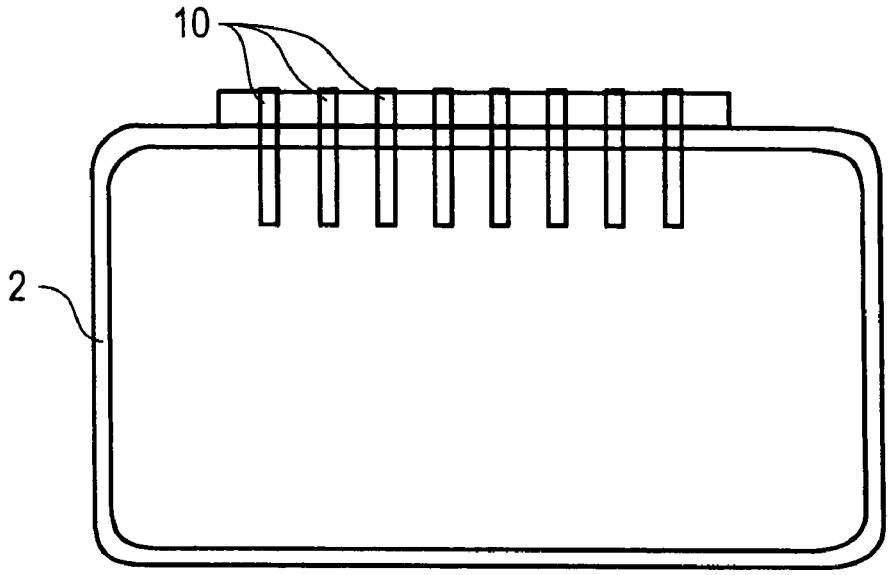
FIG. 6 shows a cross-sectional view through the powder application hopper of the powder management center from FIG. 5.

FIG. 6 shows in additional detail the arrangement of the outlets 10 in the side wall of the powder hopper 2. It can be seen from this illustration that the individual outlets 10 are exposed to almost the same suction conditions.

Figure 7:
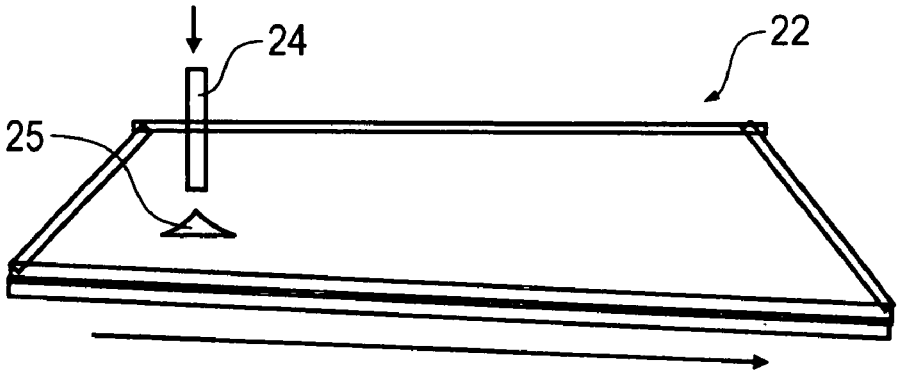
FIG. 7 shows a perspective view of an inclined screen surface in an alternative embodiment of an ultrasonic sieve.
Figure 8:
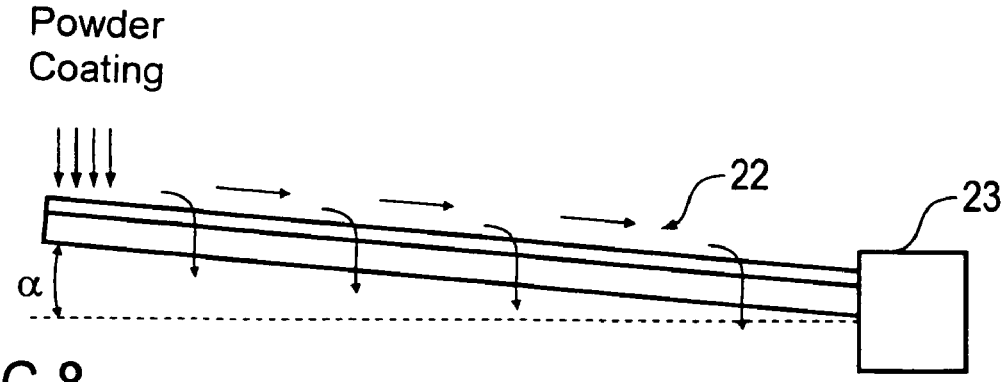
FIG. 8 shows a schematized side view of the inclined screen surface from FIG. 7.

FIGS. 7 and 8 show in a schematized form a screen surface 22, which is inclined relative to the horizontal at an angle $\alpha$ approximately equal to 5° so that dirt particles migrate on the upper side of the screen surface 22, following gravity to the lower lateral edge of the sieve surface 22 where the dirt particles are caught by a dirt remover 23. The dirt remover 23 extends in a channel along the downward inclined lateral edge of the sieve surface 22 so that the dirt particles from the entire sieve surface 22 are collected in the dirt remover 23.

The powder paint transfer takes place via a powder feed 24, which is directed at a deflector cone 25 located in the upper third of the inclined sieve surface 22.

Figure 9:
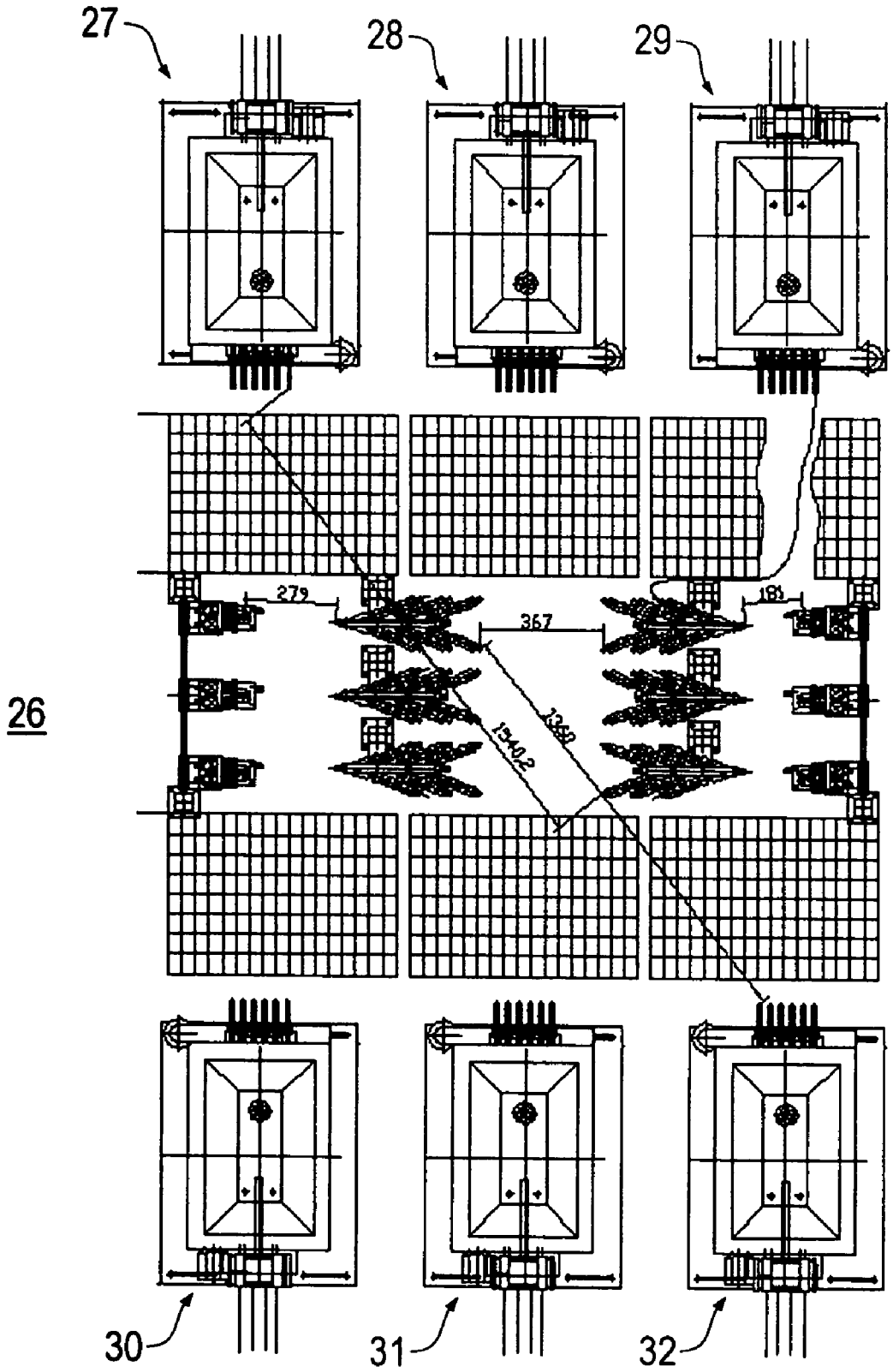
FIG. 9 shows a plan view of a paint line with several powder management centers in accordance with embodiments of the invention.

FIG. 9 shows a plan view of a material supply of a paint line 26 with several powder management centers 27-32 located to the side of, i.e., laterally next to, the paint line. The rectangular shape/design of the powder management centers 25-30 allows them to be set up close together, which makes possible a multi-color concept.

Figure 10A:
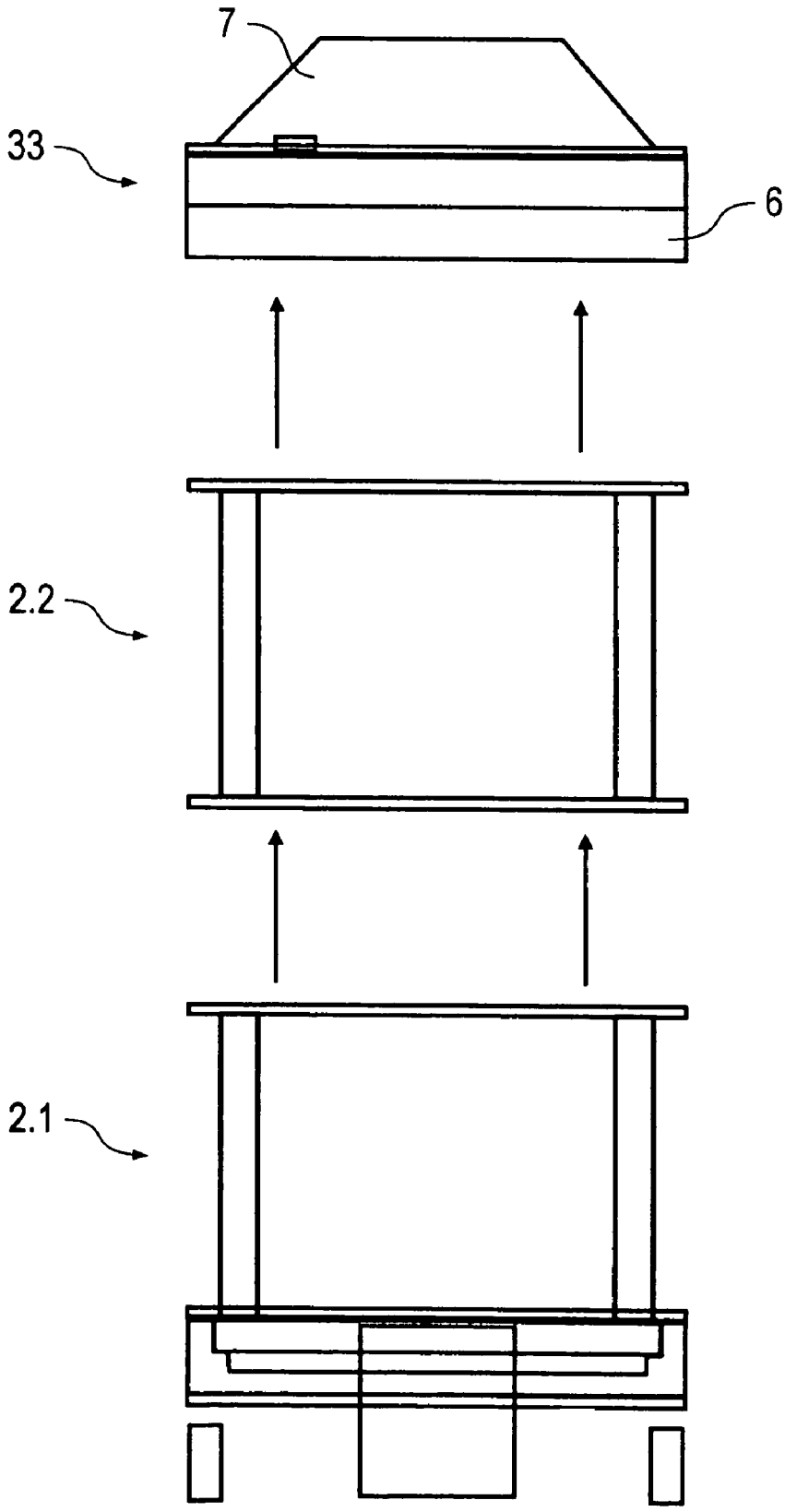
FIGS. 10A and 10B show exploded views of the powder management center from which the modular construction can be seen.
Figure 10B:
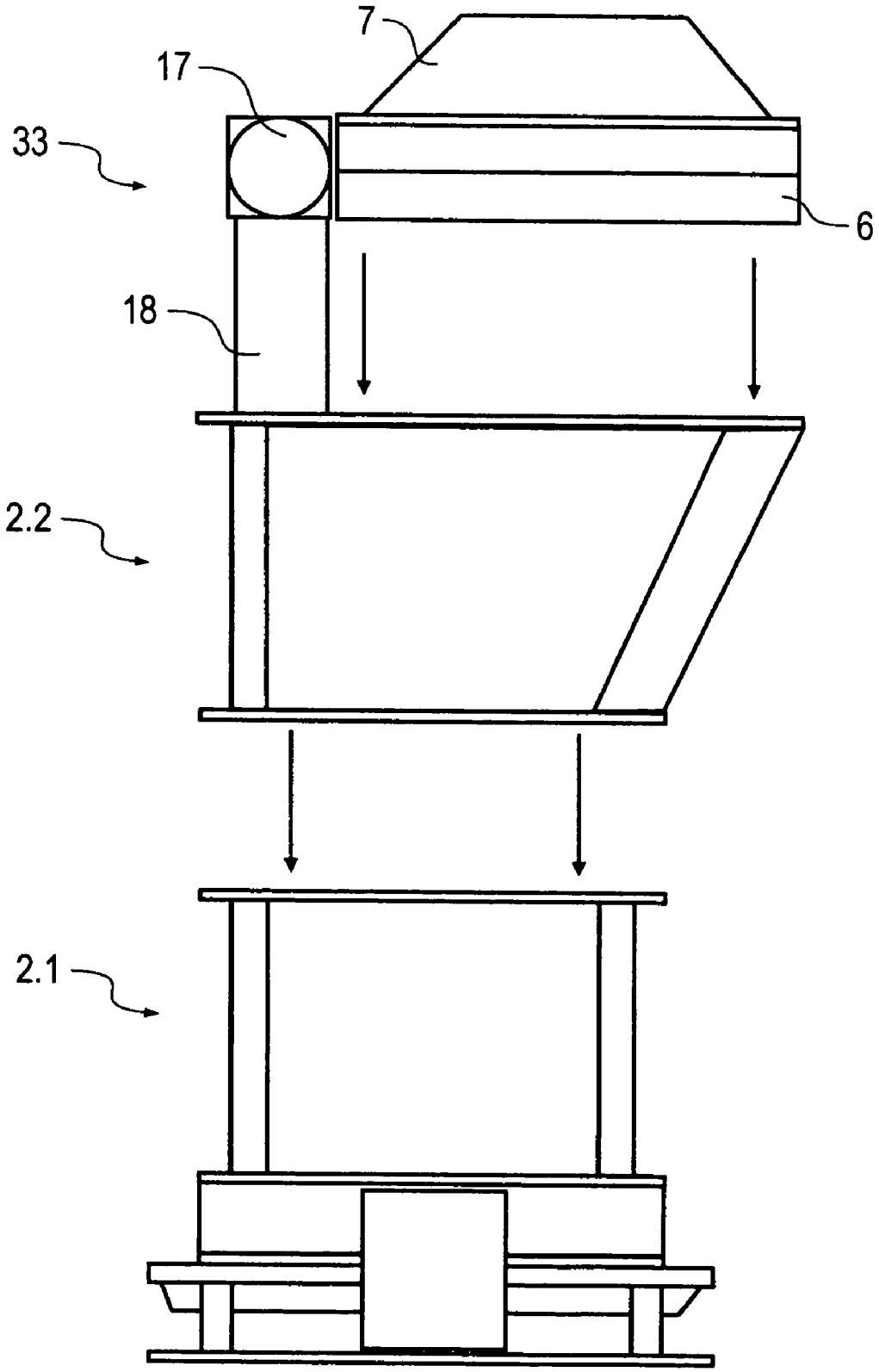

Finally, FIGS. 10A and 10B make clear the modular construction of the powder management center 1, consisting of the lower area 2.1 of the powder hopper 2, the upper area 2.2 of the powder hopper 2 and a sieve device 33.

This modular construction of the powder management center 1 permits retrofitting of conventional powder management center by replacing the upper area 2.2 of the powder hopper 2 and the sieve device 33.

The invention is not restricted to the previously described embodiments. Rather, a plurality of variations and modifications is possible which also make use of the inventive idea and therefore fall within the scope and protection of the appended claims.

What is claimed is:

1. A coating powder sieving device, the device comprising:

a screen portion for sieving a coating powder, wherein the screen portion includes a screen frame and a screen retained by the screen frame and having a screen surface; the screen frame and screen surface defining a generally quadrangular shape;

a screen support portion supporting the screen portion, including the screen frame and the screen surface, generally in a direction perpendicular to the screen surface; and an ultrasonic probe coupled to the screen portion, including the screen frame and the screen surface, with a coupling extending between the ultrasonic probe and the screen portion such that the ultrasonic probe excites vibrations in the screen surface and the screen frame via the coupling, wherein the screen is directly supported vertically solely by the screen support and the ultrasonic probe; and a vibration absorbing element positioned laterally with respect to the screen frame such that the vibration absorbing element absorbs vibrations of the screen frame in a direction generally parallel to the screen surface, wherein the vibrations in the screen surface and the screen frame occur at least substantially in a direction perpendicular to the screen surface; wherein the screen and screen frame are vibrated exclusively by the ultrasonic probe.

2. The coating powder sieving device according to claim 1 wherein the screen surface is angular.

3. The coating powder sieving device according to claim 1 wherein the screen surface has lateral edges of different lengths.

4. The coating powder sieving device according to claim 1 wherein the screen surface is inclined with respect to the horizontal so that screened out dirt particles migrate laterally.

5. The coating powder sieving device according to claim 4 wherein the screen surface opens at its downwardly inclined lateral edge into a dirt trap through which the sifted out dirt particles are removed.

6. The coating powder sieving device according to claim 4, further comprising:

a deflector cone located above the screen surface, the deflector cone located in the upper area of the inclined screen surface and distributing a coating medium on the screen surface.

7. The coating powder sieving device according to claim 1, further comprising: a deflector cone located above the screen surface, the deflector cone distributing a coating medium on the screen surface.

8. The coating powder sieving device according to claim 1 wherein the screen surface is held in place in an area of its lateral edges by at least one of a foam rubber element and a solid rubber element.

9. The coating powder sieving device according to claim 8, further comprising:

at least one rigid mount extending from the at least one of the foam rubber element and the solid rubber element, the at least one rigid mount in contact with the screen surface.

10. The coating powder sieving device according to claim 8, further comprising:

at least one rubber profile extending from the at least one of the foam rubber element and the solid rubber element, the at least one rubber profile in contact with the screen surface.

11. The coating powder sieving device of claim 1, further comprising a circumferential frame supporting the screen portion, including the screen surface and the screen frame; and wherein the vibration absorbing element is positioned between the screen portion and the circumferential frame, the vibration absorbing element configured to damp vibration transmitted to the screen portion such that the screen surface and screen frame are suspended from the circumferential frame.

12. The coating powder sieving device of claim 11, wherein the vibration absorbing element absorbs vibration in a direction corresponding to a plane of the screen surface.

13. A coating powder sieving device, the device comprising:

a screen for sieving a coating powder, the screen retained by a screen frame and defining a screen surface;

a circumferential frame extending circumferentially about the screen and screen frame, a screen support extending from the circumferential frame to support the screen generally in a direction perpendicular to the screen surface;

an ultrasonic probe coupled to the screen frame and the screen with a coupling extending between the ultrasonic probe and the screen such that the ultrasonic probe excites vibrations in the screen and the screen frame via the coupling, wherein the screen is directly supported vertically solely by the screen support and the ultrasonic probe; and a vibration absorbing element positioned between the screen frame and the circumferential frame, the vibration absorbing element positioned laterally with respect to the screen frame such that the vibration absorbing element absorbs vibrations of the screen frame in a direction generally parallel to the screen surface, the vibrations in the screen and the screen frame thereby occurring substantially in a direction perpendicular to the screen surface.

14. The coating powder sieving device of claim 13, wherein the screen frame and screen surface define a generally quadrangular shape.

* * * * *